US005170619A

United States Patent [19]

Noda

[11] Patent Number: 5,170,619

[45] Date of Patent: Dec. 15, 1992

[54] APPARATUS FOR PRODUCING YARN

[75] Inventor: Koshi Noda, Joyo, Japan

[73] Assignee: Murata Kikai Kabushiki Kaisha, Kyoto, Japan

[21] Appl. No.: 390,647

[22] Filed: Aug. 7, 1989

[30] Foreign Application Priority Data

Aug. 9, 1988 [JP] Japan ..... 63-198431

[51] Int. Cl.[5] ..... D01H 1/115

[52] U.S. Cl. ..... 57/328; 57/352

[58] Field of Search ..... 57/328, 331, 293, 294, 57/350, 352

[56] References Cited

U.S. PATENT DOCUMENTS

| | | | |
|---|---|---|---|
| 4,055,039 | 10/1977 | Movshovich et al. | 57/293 |
| 4,068,459 | 1/1978 | Movshovich et al. | 57/293 |
| 4,351,146 | 9/1982 | Faure et al. | 57/328 X |
| 4,484,436 | 11/1984 | Nakayama | 57/328 |
| 4,574,579 | 3/1986 | Chao | 57/328 |
| 4,761,946 | 8/1988 | Stahlecker | 57/328 |
| 4,819,422 | 4/1989 | Stahlecker et al. | 57/328 |
| 4,942,731 | 7/1990 | Morihashi et al. | 57/328 |
| 5,107,671 | 4/1992 | Morihashi et al. | 57/328 |

*Primary Examiner*—Katherine Matecki

*Attorney, Agent, or Firm*—Spensley Horn Jubas & Lubitz

[57] ABSTRACT

In a spinning method in which, after a bundle of fibers has been drafted, the fibers are introduced into a twisting device using an air jet. The fibers are formed into bound spun yarns by the twisting device and are wound on a package by a winding device. The spinning method includes the steps of arranging and doubling at least two spun yarns upstream from where a twisting torque applied to the spun yarn by the twisting device disappears, entangling the spun yarns by the residual twisting torque, and thereafter winding them on a package.

4 Claims, 5 Drawing Sheets

APPARATUS FOR PRODUCING YARN

FIELD OF THE INVENTION

This invention relates to a method for producing yarns, and more specifically, to a method for producing yarns comprising spinning out a bundle of fibers by a twisting device using an air jet, and drawing out and arranging and winding two or more spun yarns.

RELATED ART STATEMENT

There are well known innovative spinning machines in which a bundle of fibers such as slivers is introduced into a draft device, and the bundle of fibers drafted by the draft device is twisted by an air injection nozzle or a nip belt type twisting device or the like to form a spun yarn.

The advantages of the aforesaid innovative spinning machines are that the spinning speed is high, and the package obtained has a desired shape such as a cone. However, such machines have a disadvantage in that strength of yarn is generally low.

Means for increasing the yarn strength known so far include a method for drawing out and arranging two yarns to form a double yarn, and a method for further applying the double yarn to a twisting machine such as a two-for-one twisting machine to twist it.

In most cases, the yarn spun by the innovative spinning machine is formed into a twisted yarn after applying the latter step, that is, doubling.

More specifically, the aforesaid doubling step includes the steps of using two packages manufactured by the spinning machine, transporting the packages to a feed position of a doubler, simultaneously untwisting yarn from the two packages and unwinding it. Naturally, the doubling step requires a long unwinding time, and hands are also required.

If the package for the yarn subjected to the doubling step by the doubler is applied to the succeeding step, i.e., the two-for-one twisting machine, two spinning yarns constituting a double yarn tend to be separated at the time of untwisting it from the package. The thus separated spun yarns each become weakened because of variation of tension or twist, resulting in the cause of yarn breakage. Even if yarn. is not broken, there occurs an inconvenience in that one yarn out of the double yarn is twisted while holding slack in a part of yarn as shown in FIG. 9. The yarn having a defect as shown in FIG. 9 is naturally low in value of goods as yarn. In addition, in the later knitting step, there occurs a problem in that the yarn is caught by a threading means of a knitting needle to cause yarn breakage.

As means for preventing separation of yarns during untwisting from a package in the aforementioned twisting step, a flier is generally known. However, even if the flier is used, it is not possible to completely prevent separation of yarns. On the other hand, in case where a flier is used, a diameter of the flier remains unchanged as the package reduces in diameter with passage of time. Therefore, there occurs a further problem that when untwisting tension increases, yarn breakage tends to occur at the time when the package is small in diameter.

OBJECT AND SUMMARY OF THE INVENTION

It is an object of the present invention to propose a yarn producing method in which a doubling step can be omitted and a package composed of spun yarns loosely entangled with each other is obtained.

An embodiment of present invention provides, in a spinning method in which after a bundle of fibers has been drafted, the fibers are introduced into a twisting device using an air jet, the fibers are formed into bound spuns yarn by said twisting device, and then the spun yarns are wound on a package by a winding device, a method which comprises arranging and doubling at least two or more spun yarns at upstream from where a twisting torque applied by said twisting device and stayed in the spun yarn itself disappears, entangling the spun yarns themselves by said residual twisting torque, and thereafter winding them on a package.

DETAILED DESCRIPTION OF PREFERRED EMBODIMENTS

Embodiments will be described with reference to the drawings.

Figure 1:
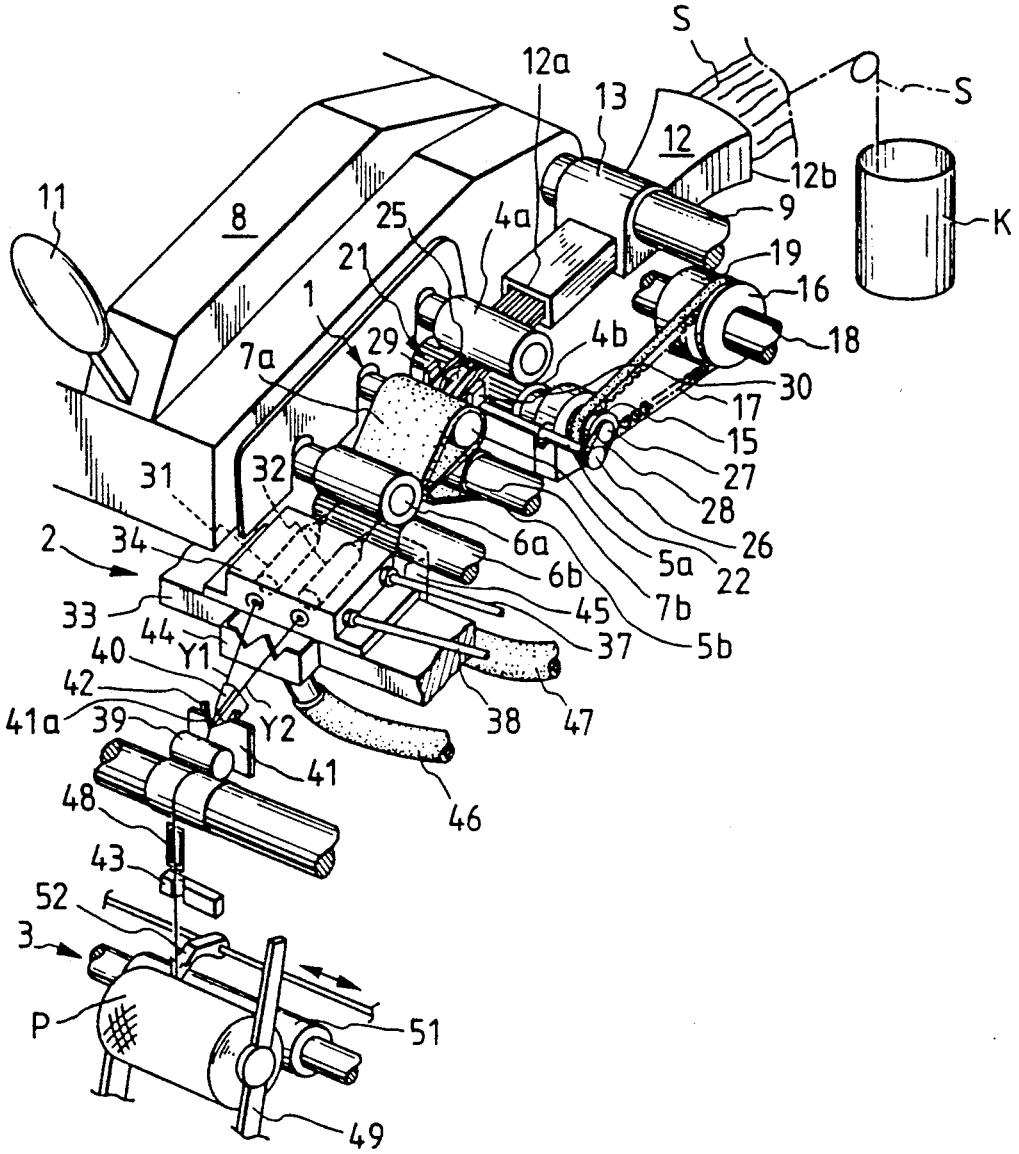
FIG. 1 is a perspective view of a spinning machine for carrying out a method according to an embodiment of the invention.

FIG. 1 is a perspective view showing a spindle of a spinning apparatus for carrying out a method according to an embodiment of the invention. The apparatus comprises a draft device 1 for drafting a sliver S supplied from a can K, a twisting device 2 using an air jet for twisting the sliver S drafted by the draft device 1 to form a yarn, and a winding device 3 for winding yarn spun.

The devices 1, 2 and 3 will be described hereinafter.

The draft device 1 comprises a pair of back rollers 4*a*, 4*b* of which peripheral speeds are set to be higher in order, a pair of middle rollers 5*a*, 5*b* and a pair of front rollers 6*a*, 6*b*, the middle rollers 5*a*, 5*b* having apron belts 7*a*, 7*b*.

Reference numeral 8 denotes a cradle for supporting the rollers 4*a*, 5*a* and 6*a* on the top side of the respective rollers, the cradle being turnable about a support shaft 9 fixed to the frame. Numeral 11 denotes a handle for raising the cradle 8, and 12 denotes a guide for the sliver mounted on the support shaft 9 through a bracket 13. The guide 12 has an outlet 12*a* of which shape is a laterally lengthy flat shape so that the sliver S may be fed in a slightly laterally lengthy sectional shape into the back rollers 4*a* and 4*b*.

In the above-described rollers 4*a*, 5*a*, 6*a*, 4*b*, 5*b* and 6*b*, the middle and front rollers are line shafts in which the rollers 5*b* and 6*b* on the bottom side extend through all spindles, the rollers being rotated when the line shaft is driven. The back rollers 4a and 4b have spindles which are independent. A line shaft 18 is operatively connected to the roller 4b through toothed pulleys 15, 16 and a toothed belt 17 so that the roller is rotated. An electromagnetic clutch 19 is mounted on the toothed pulley 16. This clutch 19 is engaged and disengaged so that with respect to the back rollers 4a and 4b, starting and stopping of each spindle are controlled.

In this embodiment, between the back rollers 4a, 4b and the middle rollers 5a, 5b is provided a sliver separation guide device 21 which will be described below.

Figure 2:
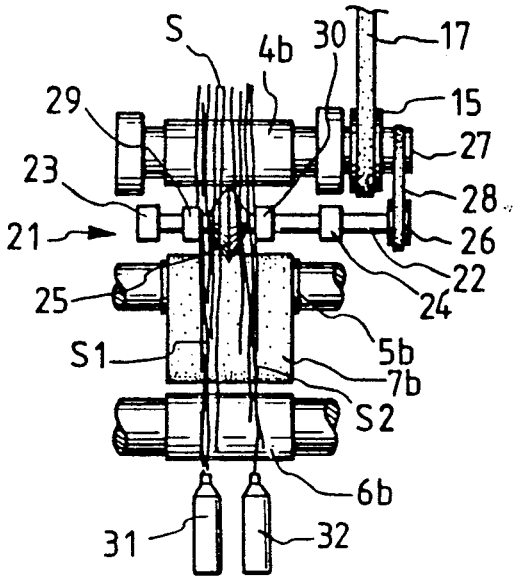
FIG. 2 is a plan view of a draft device.

That is, as shown in FIG. 2, a further shaft 22 is supported by bearings 23, 24 between the back rollers 4a, 4b and the middle rollers 5a, 5b. A rotary body 25 having a substantially diamond-shape in longitudinal sectional section is secured to the shaft 22, and a toothed pulley 26 secured to the end of the shaft 22 is connected by belt 28 to a toothed pulley 27 secured to the pulley 15. The rotary body 25 is rotated in the same speed and same direction as that of the back rollers 4a and 4b between the back rollers 4a, 4b and the middle rollers 5a, 5b.

The rotary body 25 is positioned in the central portion widthwise of the sliver S passage, and the peripheral edge portion thereof is positioned to be upwardly projected extending through the sliver S passage so that the sliver S moved out of the back rollers 4a and 4b may be separated into two rows $S_1$ and $S_2$ having the same width.

To left and right of the rotary body 25, guide blocks 29 and 30 are secured to the frame so as to define lateral spreading of two rows of slivers $S_1$ and $S_2$.

The two rows of slivers $S_1$ and $S_2$ separated at the position of the rotary body 25 are drafted while maintaining the parallel two rows even at the position of the middle rollers 5a and 5b and at the position of the front rollers 6a and 6b and thence introduced into air injection nozzles 31 and 32 which will be described later.

The position of the rotary body 25 may be set between the back rollers 4a and 4b and the sliver guide 12, in which case, the sliver guide 12 is provided, on its interior with a partitioning wall 12c which divides the interior thereof into two left and right chambers so that two rows of slivers (S) may be introduced at the inlet 12b of the sliver guide 12, then separation thereof is carried out in a satisfactory manner. That is, in this case, the slivers are in the state of two slivers already separated within a single can K or they are supplied from two cans.

A fixed separation guide member may be used in place of the rotary body 25. However, in case where the fixed guide is used, fibers constituting the sliver S which is moving within the draft device 1 at a predetermined speed come into contact with the fixed guide member so that the fibers are bent to likely produce a so-called hook fiber. The sliver separation guide device 21 is therefore preferably a moving member like the rotary body 25 which moves at substantially similar speed to the moving speed of the sliver S.

The twisting device 2 will be described hereinafter. In this twisting device 2, a housing 34 secured to a frame 33 is interiorly provided with two parallel rows of air jet nozzles 31 and 32 composed of two serially-disposed air nozzles 35 and 36 (hereinafter, upstream is called a first nozzle 35, and downstream called a second nozzle 36). The air jet nozzles 31 and 32 each have a function to independently twist the slivers $S_1$ and $S_2$ supplied to form spun yarns $Y_1$ and $Y_2$.

Since the air jet nozzles 31 and 32 have the same mechanism, only one of which will be described.

Figure 3:
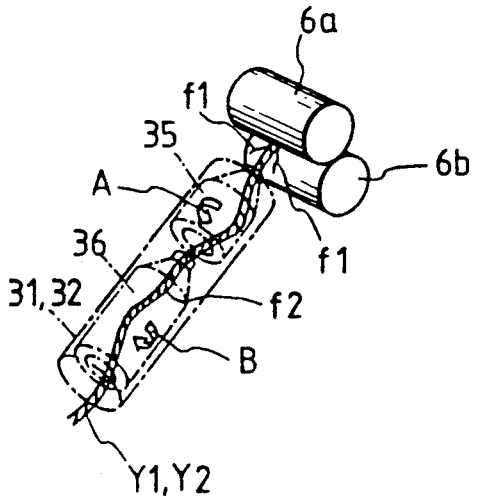
FIG. 3 illustrates a spinning process by air jet nozzles.
Figure 4:
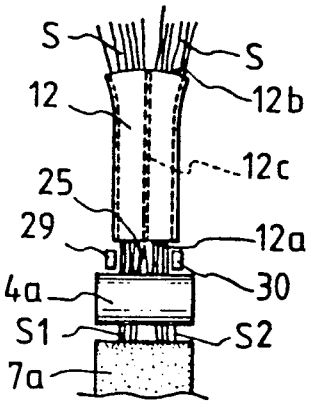
FIG. 4 is a plan view showing a further example of a sliver guide.

As shown in FIG. 3, the aforesaid first and second nozzles 35 and 36 are provided with a plurality of air jetting fine-diameter pores for jetting tangentially toward and into a passage of the sliver S formed extending through the center axes thereof so that air currents which turn in directions opposite to each other in directions A and B by said air jetting fine-diameter pores (not shown). Reference numeral 37 and 38 denote supply pipes for pressurized air to the first and second nozzles 35 and 36.

The spinning process conducted by the air jetting nozzles 31 and 32 is carried out in the following procedure.

False twists are applied to the sliver S introduced into the passage in the said direction by the turning air current B, and the false twists are transmitted up to a position near the nip point by the front rollers 6a and 6b.

The sliver S fed out of the front rollers 6a and 6b is gathered by the false twists effected by the second nozzle 36. The sliver S is ballooned in the direction which is reversed to the direction of false twist imparted by the first nozzle 35 between the front rollers 6a, 6b and the first nozzle 35. The fiber f is wound on a core fiber bundle $f_2$ in the direction reversed to the false twist caused by the second nozzle 36 by the balloon in the direction reverse to the false twist between the front rollers 6a, 6b and the first nozzle 35 and the air current A of the first nozzle 35. The fiber $f_1$ is more powerfully wound about the core fiber bundle $f_2$ with sufficient turns in the direction reverse to the false twist inserted during the process where the fiber passes through the second nozzle 36 and the false twist is released, to form so-called bound spun yarns $Y_1$ and $Y_2$.

The aforementioned spinning process will be described in more detail paying attention to the twisting amount with respect to the core fiber bundle, the $f_2$ and the open end fiber $f_1$.

Figure 5:
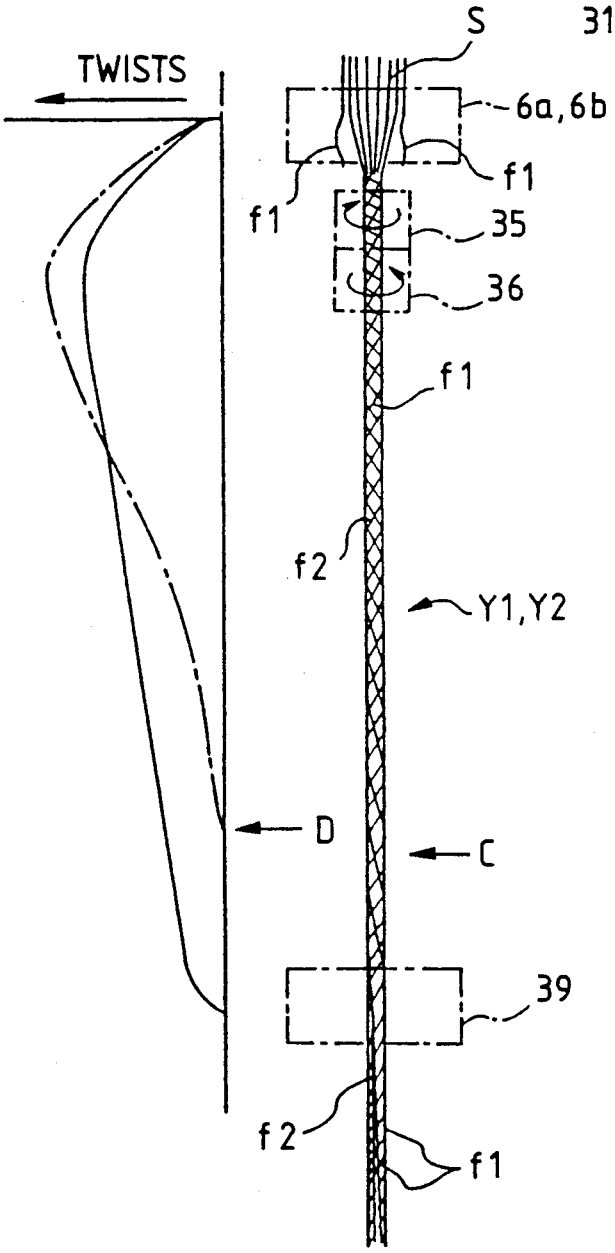
FIG. 5 is a view showing variation in twisting amount with respect to a core fiber bundle in the spinning step.

As shown in FIG. 5, the twisting amount applied to the core fiber bundle $f_2$ is largest at the position of the second nozzle 36, is zero, upstream, at the nip position caused by the front rollers 6a and 6b, and is zero, downstream, at the nip position caused by a delivery roller 39. The sliver S upstream is further moved in parallel by the front rollers 6a and 6b. At downstream, further away from the delivery roller 39, the core fiber bundle $f_2$ rapidly releases its possessed torque due to the absence of a nip point and is substantially parallel. That is, the core fiber bundle $f_2$ possesses some twisting torque between the front rollers 6a, 6b and the delivery roller 39.

The open end fiber $f_1$ wound about the core fiber bundle $f_2$ by the first nozzle 35 is strengthened in outer peripheral winding (increase in the number of turns and increase in winding force) by the core fiber bundle $f_2$ which gradually releases (untwisting) its possessed torque halfway of movement thereof from the second nozzle 36 to the delivery roller 39. In this embodiment, two yarns $Y_1$ and $Y_2$ which are formed into bound spun yarns via the aforesaid spinning process are drawn out and arranged upstream (for example, point C in FIG. 5) from the delivery roller 39 position where said twisting torque disappears, and at least the open end fiber $f_1$ is moved closer to the other spun yarns $Y_1$ and $Y_2$ to a degree that they contact and entangle with each other and are then doubled. The two doubled yarns are wound. Reference numeral 41 denotes a guide plate formed with a V-groove 41*a* for doubling, and numeral 40 denotes a guide plate which prevent said doubling point from floating up and down along the yarn running area. This guide plate 40 can prevent the doubling point from being moved toward the upstream to prevent irregularity in entangling amount of the spun yarns $Y_1$ and $Y_2$ produced when the doubling point floats toward the upstream.

Figure 7:
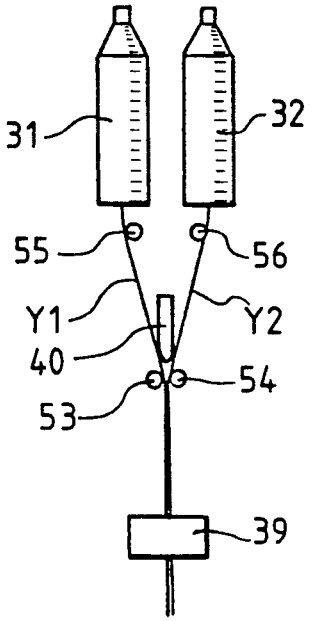
FIG. 7 is a view showing a further example of a yarn guide in the vicinity of the doubled point.

In place of the guide plate 41, two guide pins 53 and 54 separated from each other by a predetermined distance as shown in FIG. 7 may be provided, and guide pins 55 and 56 may be provided immediately after the second nozzle 36.

It is noted that the above-described two rows of air jet nozzles 31, 32 are not parallel but may be of a V-shaped arrangement wherein each connects the guide plate 41 position (doubling position) with the sliver outlet position of the front rollers 6*a* and 6*b*or may be of an arrangement wherein the first nozzles 35 and 35 are parallel, and only the second nozzles 36 and 36 are directed toward the guide plate 41 position (doubling position).

Reference numeral 42 denotes a cutter provided at the guide plate 41 position, the cutter 42 being actuated by a yarn defect detection signal from a slub catcher 43 provided halfway of a yarn running area moving down toward the winding device 3 via the delivery roller 39 to detect a yarn defective portion.

Reference numerals 44 and 45 denote dust suction ports for waste yarn, flies or the like. Numerals 46 and 47 denote suction pipes for air.

Reference numeral 48 denotes a suction pipe for removing slack of yarn called a slack tube which sucks yarn spun out of the air jet nozzles 31 and 32 to prevent slack of yarn when spinning starts or at the time of yarn joining.

The winding device 3 is composed of a bobbin supported on a well-known cradle arm 49, a friction roller 51 in rolling contact with the bobbin (or package) for rotation, and a traverse guide 52.

Assuming that the turning direction of the first and second nozzles 35 and 36 is made in the direction reversed with each other and the winding direction of $f_1$ of the outer peripheral fiber of the bundled spinning yarn spun out of the air jet nozzles 31 and 32 is made in the reverse direction, i.e., one is S-twist yarn while the other is Z-twist yarn, yarn property after formed into a double yarn becomes superior to that of the case where S-twist or Z-twist yarns are put together with each other due to the action in which directivities are negated with each other.

Anyhow, in the spinning apparatus shown in the above-described example, the sliver S supplied from the can K is separated into two rows (possibly more than 3 rows according to the shape of the separation guide device 21) halfway of a channel at least leading to the middle rollers 5*a* and 5*b* position of the draft position, and the sliver S in the separated state passes between the middle rollers 5*a*, 5*b* and the front rollers 6*a*, 6*b* to subject to drafting.

Accordingly, the two rows of slivers S1 and S2 moved out of the front rollers 6*a* and 6*b* are subjected to the desired drafting and introduced into the air jet nozzles 31 and 32, after which they are spun out in the form of two spun yarns Y1 and Y2. These two spinning yarns $Y_1$ and $Y_2$ still possess a twist torque therein till they pass through the delivery roller 39, that is, what is called in the yarn forming course, and the two spinning yarns are drawn out and doubled by the guide plate 41 or guide pins 53 and 54 during the time the twist torque remains. Therefore, at the doubled point, the yarns are loosely entangled each other in the following manner.

The open end fiber $f_1$ being wound about the core fiber bundle $f_2$ is originally the fiber with one end free as previously mentioned. Even after the fiber $f_1$ is moved out of the nozzles 31 and 32, a part thereof is present with one end projected in the form of fluff. The fiber $f_1$ is not contributed to formation of yarn, and in the course in which the twist torque as shown in FIG. 5 of the core fiber bundle $f_2$ disappears, the fiber $f_1$ advances toward the downstream of the yarn running area while turning about the yarn as the core fiber bundle $f_2$ untwines, and catches and becomes entangled with other spun yarns $Y_1$ and $Y_2$ at the doubled point (guide plate 41 or guide pins 53, 54) (FIG. 6).

The twist torque remaining in the core fiber bundle $f_2$ due to the entanglement of the open end fiber $f_1$ is urged to be released. The twist torque to be released causes the spun yarns $Y_1$ and $Y_2$ to be entangled with each other in a direction S-twist or Z-twist as shown in FIG. 6. The entanglement of the spun yarns $Y_1$ and $Y_2$ originally results merely from only the untwisting force due to the residual torque, and therefore, the twist frequency is less (approximately 50 to 100 per yarn length of 1 m), and when the S-twist portion continues, the Z-twist portion is then generated by the torque accumulated by the S-twist.

Figure 6:
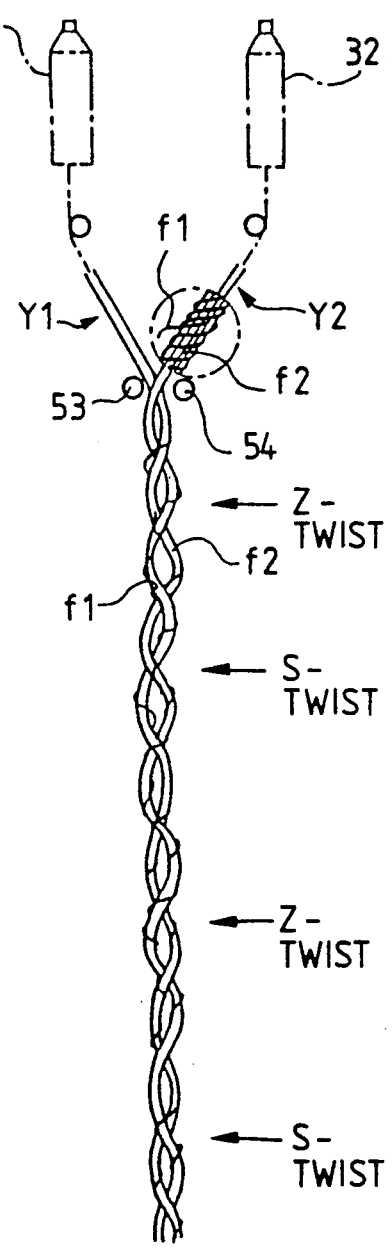
FIG. 6 is a view schematically showing an entangling state of yarns at downstream of a doubled point.

In the mode of the double yarn shown in FIG. 6, the spun yarns $Y_1$ and $Y_2$ themselves are of the Z-twist but the twist of each spun yarn itself may be of either S or Z as mentioned above, e.g., one may be S while the other may be Z.

The spun yarns $Y_1$ and $Y_2$ loosely entangled ("entangled" herein termed indicates both the entanglement of the open end fiber $f_1$ with the other spinning yarn and the entanglement of the spinning yarns $Y_1$ and $Y_2$ each other as shown in FIG. 6, but sometimes indicates the case of the latter entanglement which is extremely small in frequency) are wound as a single package as they are, which are then transferred to the succeeding twisting step. Even halfway of the transfer and in the twisting step, the spinning yarns loosely entangled as mentioned above are not easily separated, and therefore the later treatment is very easy and can be handled easily.

Figure 8:
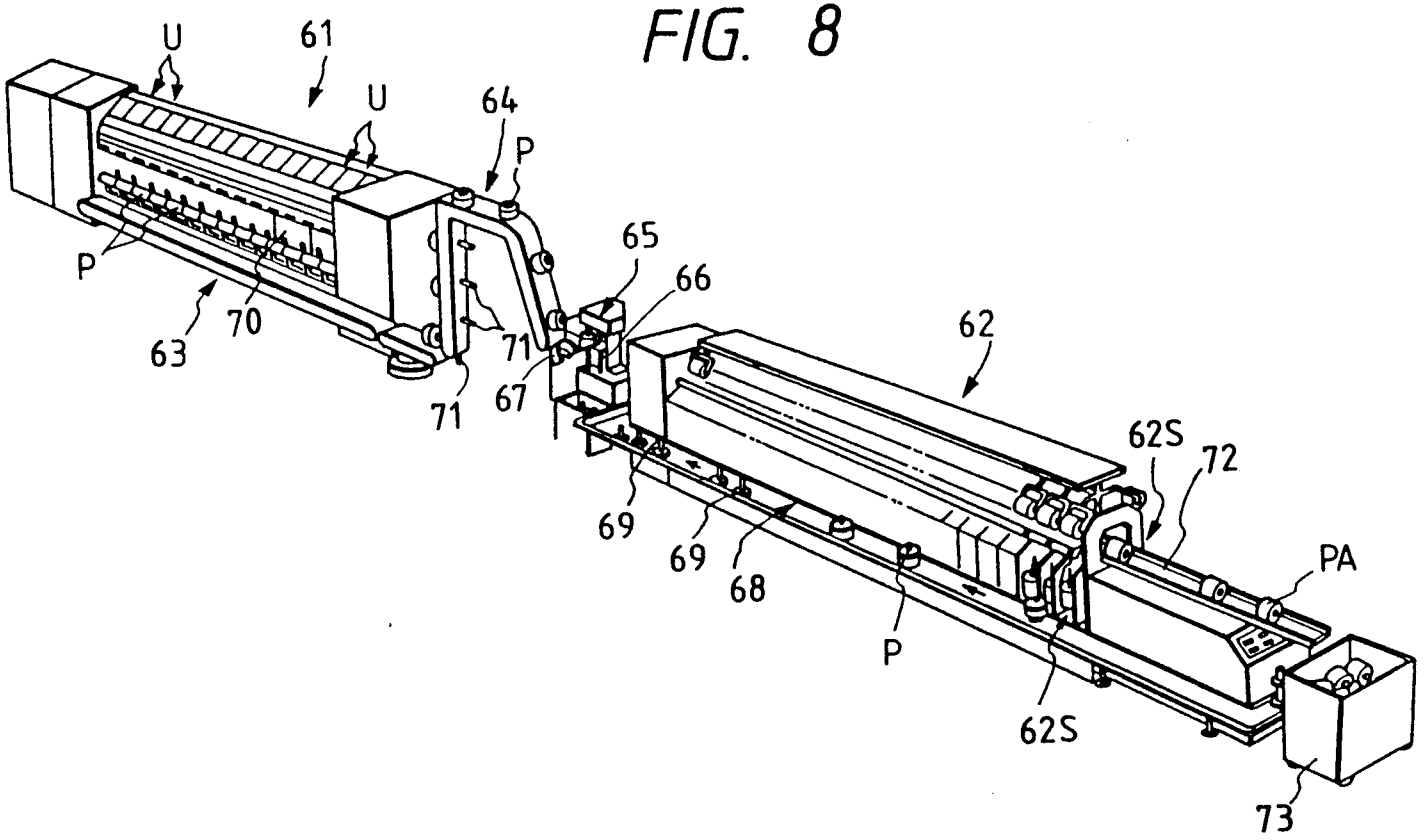
FIG. 8 is a perspective view showing a system in which a spinning machine and a two-for-one twisting machine are connected.

A system shown in FIG. 8 is one in which the transfer of yarn to the twisting step is automated.

That is, a spinning machine 61 with a number of spindles U provided thereon in the aforementioned embodiment and a two-for-one twisting machine 62 are connected by a belt conveyor 63 provided immediately before the spinning machine 61 to transfer a doffing package, a gate conveyor 64 connected to the conveyor 63, and a package supply device 65 for receiving a package P from the gate conveyor 64 to supply it to the two-for-one twisting machine 62. In the supply device 65, a receiving member 67 which is turnable about a shaft 66 and movable up and down along the shaft 66 receives a package P delivered out of the gate conveyor 64 which is turned and moved up and down according to a predetermined program and deliver it onto an empty tray 60 which is circulatingly moved around the two-for-one twisting machine 62 by means of a conveyor 68. Reference numeral 70 denotes a doffing truck running along each spindle of the spinning machine 61, 71 are pegs planted on the belt of the gate conveyor 64, and 72 is a belt conveyor for carrying a doffed package PA to a box 73 outside the machine.

In the above-described system, the package P in an uneasily separable double yarn state is directly transferred to the two-for-one twisting machine 62, and the twisting step is immediately carried out. Of course, in each spindle 62*s* of the two-for-one twisting machine 62, a flier is not required since untwisted yarn of each package is not easily separable, and untwisting tension is not varied due to a reduction in diameter of a package.

In FIGS. 1 and 7, the depth of the V-groove 41*a* of the guide plate 41 and the spacing between the guide pins 53 and 54 may be such that the fluff-like open end fibers $f_1$ of the spun yarns $Y_1$ and $Y_2$ passing therethrough are entangled with each other. Accordingly, more specifically, said spacing may be a spacing of the size which at least both coarseness are put together and there is no need to have a narrow spacing to a degree such that both the spun yarns $Y_1$ and $Y_2$ are made close to each other to impart a great resistance thereto.

As will be apparent from the foregoing, the doubled points, that is, the guide plate 41 position and the guide pins 53 and 54 position empty the twist torque remaining at least in the core fiber bundle $f_2$. Therefore, in the case of producing a yarn having an extremely fine count, the torque in the core fiber bundle $f_2$ sometimes disappears at a position (indicated at point D in FIG. 5) considerably away from upstream of the delivery roller 39. In this case, the doubled point is set at least to a point upstream of the point D where torque disappears.

Figure 9:
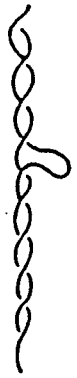
FIG. 9 illustrates a defective portion in the twisting process.

As will be apparent from the above description, according to this invention, the doubling step mentioned in the beginning can be omitted, and a package composed of yarns loosely entangled with each other is obtained. Occurrence of troubles such that single yarns are separated from each other and tensions of the single yarns are different and that wall twist which is defective twist as shown in FIG. 9, yarn cut or the like occur due to such difference in tension can be well prevented, and accordingly, excellent yarns can be easily produced.

What is claimed is:

1. Apparatus for producing multiplied yarn from a sliver passed along a path toward a package, the apparatus comprising:

a drafting device for drafting the sliver;

a sliver guide for separating the sliver into a plurality of rows of slivers;

a plurality of twisters for twisting the plurality of rows of slivers, respectively, to provide a respective plurality of spun yarns, each twister having first and second nozzles for providing air flows in opposite tangential directions with respect to each other;

a winding device for winding yarn about the package, the winding device having a delivery roller;

a first guide plate disposed upstream of the delivery roller and having a V-shaped passage for passing therethrough the plurality of spun yarns and for converging the spun yarns at a converging point; and a second guide plate arranged upstream of the first guide plate to prevent the converging point from moving upstream along the yarn path.

2. Apparatus as claimed in claim 1, wherein the first guide plate comprises means for entangling fluff-like open end fibers of at least one of the spun yarns passing therethrough with fluff-like open end fibers of another of the spun yarns passing therethrough.

3. Apparatus for producing multiplied yarn from a sliver passed along a path toward a package, the apparatus comprising:

a drafting device for drafting the sliver;

a sliver guide for separating the sliver into a plurality of rows of slivers;

a plurality of twisters for twisting the plurality of rows of slivers, respectively, to provide a respective plurality of spun yarns, each twister having first and second nozzles for providing air flows in opposite tangential directions with respect to each other;

a winding device for winding yarn about the package, the winding device having a delivery roller;

two guide pins defining a passage therebetween for passing therethrough the plurality of spun yarns and for converging the spun yarns at a converging point; and a guide plate arranged upstream of the two guide pins to prevent the converging point from moving upstream along the yarn path.

4. Apparatus as claimed in claim 3, wherein the two guide pins comprise means for entangling fluff-like open end fibers of at least one of the spun yarns passing therebetween with fluff-like open end fibers of another of the spun yarns passing therebetween.

* * * * *